United States Patent [19]

Nishimura et al.

[11] Patent Number: 4,989,044

[45] Date of Patent: Jan. 29, 1991

[54] DEVELOPING APPARATUS FOR DEVELOPING ELECTROSTATIC LATENT IMAGES

[75] Inventors: Katsuhiko Nishimura, Yokohama; Michihito Yamazaki, Tokyo; Keiji Okano, Yokohama; Motoi Katoh, Yokohama; Kouichi Suwa, Yokohama; Yasushi Sato; Kimio Nakahata, both of Kawasaki, all of Japan

[73] Assignee: Canon Kabushiki Kaisha, Tokyo, Japan

[21] Appl. No.: 341,352

[22] Filed: Apr. 21, 1989

[30] Foreign Application Priority Data

| | | | |
|---|---|---|---|
| Apr. 27, 1988 | [JP] | Japan | 63-106463 |
| Apr. 28, 1988 | [JP] | Japan | 63-108803 |
| Dec. 22, 1988 | [JP] | Japan | 63-322039 |

[51] Int. Cl.[5] ..... G03G 15/08

[52] U.S. Cl. ..... 355/251; 355/253

[58] Field of Search ..... 355/245, 251, 253, 259, 355/261, 265; 118/657, 658, 661, 651, 647

[56] References Cited

U.S. PATENT DOCUMENTS

| | | | |
|---|---|---|---|
| 3,863,603 | 2/1975 | Buckley et al. | 355/251 X |
| 4,034,709 | 7/1977 | Fraser et al. | 355/251 X |
| 4,350,749 | 9/1982 | Ohnuma et al. | 430/100 |
| 4,368,971 | 1/1983 | Watanabe et al. | 355/253 |
| 4,395,110 | 7/1983 | Hosono et al. | 118/657 X |
| 4,422,749 | 12/1983 | Hoshino et al. | 118/657 X |
| 4,425,382 | 1/1984 | Tajima | 118/657 X |
| 4,526,130 | 7/1985 | Fukada et al. | 118/657 |
| 4,564,285 | 1/1986 | Yasuda et al. | 118/651 |
| 4,597,661 | 7/1986 | Yamashita | 355/251 X |
| 4,873,940 | 10/1989 | Ishikawa et al. | 355/251 X |

FOREIGN PATENT DOCUMENTS

| | | |
|---|---|---|
| 2460782 | 7/1976 | Fed. Rep. of Germany . |
| 3303167 | 8/1983 | Fed. Rep. of Germany . |
| 2954126 | 12/1984 | Fed. Rep. of Germany . |

*Primary Examiner*—Arthur C. Prescott

*Attorney, Agent, or Firm*—Fitzpatrick, Cella, Harper & Scinto

[57] ABSTRACT

A developing apparatus using one component developer includes a developing sleeve for carrying the developer to a developing zone. The developing sleeve has an outer coating layer made of resin material in which electrically conductive fine particles are dispersed.

28 Claims, 4 Drawing Sheets

DEVELOPING APPARATUS FOR DEVELOPING ELECTROSTATIC LATENT IMAGES

FIELD OF THE INVENTION AND RELATED ART

The present invention relates to a developing apparatus for developing an electrostatic latent image with one component developer.

A developing apparatus using one component developer is widely used in electrophotographic copying machines and electrophotographic printers. The one component developer in the specification means a dry developer not containing carrier particles which are contained in a two component developer. However, the one component developer is not limited to the developer consisting of toner particles, but includes a developer containing, in addition to toner particles, one or more additional powders or agents for the purpose of enhancing fluidability of the developer, controlling charge amount of the toner or cleaning the surface of an image bearing member.

As compared with the developing apparatus using the two component developer, the developing apparatus using the one component developer can be easily reduced in size, and it is not necessary to be provided with means, necessitated in two component developer, for maintaining a constant toner ratio in the developer comprising the toner particles and carrier particles, and therefore, the structure is simple.

In the developing apparatus using the one component developer, the toner particles are triboelectrically charged by friction with a developer carrying member to a polarity suitable for developing the latent image. In that area of the developer carrying member which is opposed to a non-image area (background) of the image bearing member, the developer is not consumed. If the state of this no-consumption of the developer continues, a layer of fine developer particles is strongly deposited thereon presumably due to electrostatic image force, and they are not easily consumed for development of the image area of the image bearing member once the strong deposition is established. In addition, the existence of such a strongly deposited layer decreases the amount of charge of the developer present on the strongly deposited fine particle layer. This results in production of a ghost image on a developed image, thus deteriorating the image quality.

For example, it is known that silica produced by vapor phase method (dry silica) or silica produced by wet method (wet silica) is added to the toner powder in order to control the amount of triboelectric charge of the one component developer.

For example, the dry fine silica particles exhibiting a strong negative charging property (produced by adding to 100 $m^2$ silica particles produced by the vapor phase method, 10% by weight of HMDS and then heating them) are added to a negatively chargeable magnetic toner containing styrene acryl copolymer and 60% by weight of magnetite. By this, the amount of triboelectric charge increases. When a developing operation is performed using such a developer in a known jumping developing system (for example, U.S. Pat. No. 4,292,387) wherein a thin layer of the developer is formed on the sleeve 8, the image density is higher than when the silica is not added, and the resultant images are finer and smoother, as is known.

However, if the strongly negatively chargeable silica is added to the negatively chargeable toner, a sleeve ghost appears on the developing sleeve. The sleeve ghost is a hysteresis of the print pattern. It appears on the printed image, too. The sleeve ghost appearing when the negatively chargeable silica is added to the negatively chargeable toner, results in a developed image having a positive ghost as shown in FIG. 2.

More particularly, there are a portion (a) in which light developed image appears due to continuation of non-printing (white area) and a portion (b) in which the dark image appears due to contination of printing (black). The experiments and investigations by the inventors have revealed that the mechanism of the ghost production is related with the fine particle layer (not more than 5–6 microns particle size) on the sleeve. The particle size distribution in the bottommost toner layer on the developing sleeve is different in the toner consumed portion than in the not-consumed portion. More particularly, the fine particle layer is formed at the bottom of the non-consumed portion. Since a fine particle has a larger surface area per unit volume, the amount of triboelectric charge per unit weight is larger than a large size particle. Therefore, the fine particles are more strongly attracted to the sleeve by the electrostatic force due to the image force. Thus, the toner particles outside the portion where the fine particle layer is formed, are not sufficiently triboelectrically charged by the friction with the developing sleeve, and therefore, their developing power decreases, and they appear as a ghost on the image.

Under high temperature or high humidity conditions, particularly the high humidity conditions, the developer, particularly the silica absorbs the moisture with the result of decreased amount of electric charge of the developer. Therefore, it is usual that even if a good image density is provided under low humidity conditions and normal conditions, the image density decreases, and the image is roughened, under the high humidity conditions.

Therefore, some attempts have been made to prevent absorption of the moisture by the silica, by providing hydrophobic nature with the silica to be added to the developer.

Such hydrophobic silica allows stabilized charging of the developer under high humidity conditions, but the charge amount becomes extremely large under the low humidity conditions, and particularly the fine size particles in the developer are charged up with the result of the tendency of producing the ghost image. The image density difference of the ghost image is large particularly when a hydrophobic silica having a negatively chargeable property is added to the negatively chargeable toner.

Generally, the volume average particle size of a dry one component magnetic developer conventionally used is 10–14 microns. Particularly, in the above-mentioned developing method, the volume average particle size of the magnetic toner is 12 microns. More in detail, the magnetic toner contains not more than approximately 20%, in the number distribution, of the particles having a volume average particle size of not more than 6.35 microns, and contains not more than approximately 2%, in the volume distribution, of the particles having a volume average particle size of not less than 20.2 microns.

Recently, further reduction of the toner size becomes desired because of the demand for a further high quality of the images. For example, in the case of an electrophotographic laser beam printer, to increase the printing density from conventional 300 DPI to 600 DPI (23.6 Pel) for the purpose of increasing the resolution and sharpness, therefore, faithfulness of the latent image, is relatively easily accomplished if the toner having the particle size 8–6 microns is used. As an example of the fine particle toner, the volume average particle size is 6.0 microns; and the one component magnetic toner contains not more than approximately 20%, in the number distribution, of the particles having the volume average particle size of not more than 3.5 microns and contains not more than approximately 1%, in the volume distribution, of the particles having the volume average particle size of not less than 16 microns. If the toner contains nigrosine or the like as the charging control agent, and if it is a positively chargeable toner, 0.8% by weight of silica treated with amino-converted silicone oil is added, and then, it is used as the developer.

However, since the small particle size toner has larger surface areas per unit volume as compared with the conventional toner, the amount of charge per unit volume or unit weight increases by approximately 30% when measured by a two-component triboelectric measurement method. Also, since the amount of fine particles having the particle size of not more than 5 microns greatly increases, the resin content in the toner increases, and as a result, the surface of the developer carrying member such as the developing sleeve is easily contaminated by the high triboelectrically charged fine particles. This tends to increase the possibility of ghost image production.

As a measure for the above problems, it is known to contact a scraper to the developing sleeve to positively remove the toner after development from the developing sleeve, to apply a bias voltage which is different from the bias voltage at the time of the developing action so as to transfer the toner after the developer is electrostatically transferred from the developing sleeve to the image bearing member, or to face a grounded metal plate or roller to the developing sleeve to remove the toner after development from the developing sleeve Those methods result in a complicated structure with an increase of cost.

SUMMARY OF THE INVENTION

Accordingly, it is a principal object of the present invention to provide a developing apparatus wherein the developer fine particles are prevented from strongly being deposited on a developer carrying member to provide developed images having good image densities.

It is another object of the present invention to provide a developing apparatus wherein the amount of triboelectric charge of the toner can be stabilized, and the distribution of the amount of triboelectric charge is discretely.

It is a further object of the present invention to provide a developing apparatus wherein the developer is prevented from extreme charging up even under low humidity conditions, thus providing good developed images.

It is a further object of the present invention to provide a developing apparatus wherein even if a negatively charged toner is used, the ghost development can be prevented, thus providing good developed images.

It is a further object of the present invention to provide a developing apparatus wherein even if negatively chargeable toner, negatively chargeable hydrophobic silica are contained in the developer, good developed images can be provided with limited ghost image even under low humidity conditions.

It is a further object of the present invention to provide a developing apparatus wherein the production of the ghost image is minimized even when the developer has a small volume average particle size.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 1:
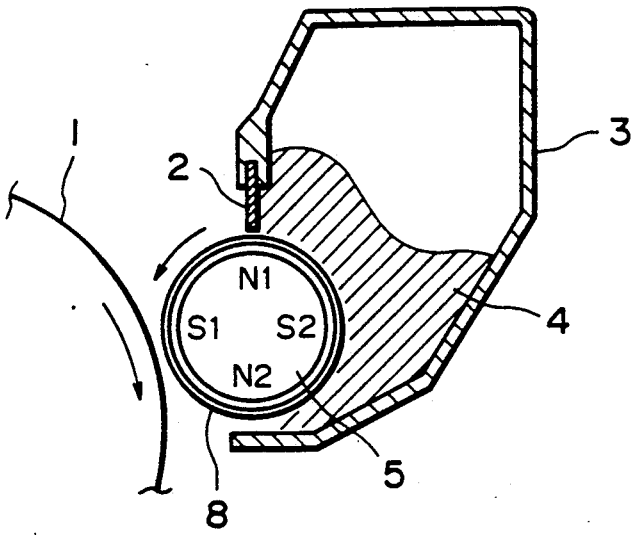
FIG. 1 is a sectional view of a conventional developing apparatus.
Figure 2:
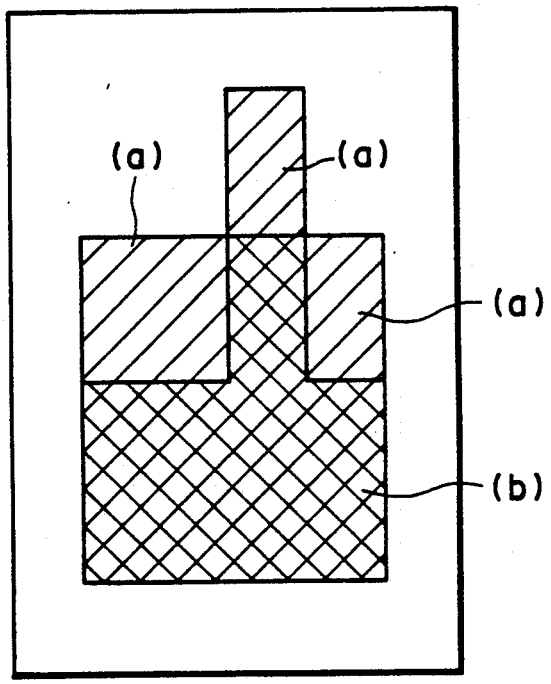
FIG. 2 illustrates production of a ghost image.

Binder resin of a one component magnetic developer used with the embodiments of the present invention may be the following or a mixture of the following polymer of styrene and substitute thereof such as polystyrene and polyvinyltoluene; styrene copolymer such as styrene-propylene copolymer, styrene-vinyltoluene copolymer, styrene-vinylnaphthalene copolymer, styrene-acrylic acid methyl copolymer, styrene-acrylic acid ethyl copolymer, styrene-acrylic acid butyl copolymer, styrene-acrylic acid octyl copolymer, styrene-acrylic acid dimethylaminoethyl copolymer, styrene-methacrylic acid methyl copolymer, styrene-methacrylic acid ethyl copolymer, styrene-methacrylic acid butyl copolymer, styrene-methacrylate dimethylaminoethyl copolymer, styrene-vinylmethylether copolymer, styrene-vinylethylether cbpolymer, styrene-vinylmethylketone copolymer, styrene-butadiene copolymer, styrene-isoprene copolymer, styrene-maleic acid, styrene-maleic acid ester copolymer; polymethylmethacrylate, polybutylmethacrylate, polyvinylacetate, polyethylene, polypropylene, polyvinylbutyral, polyacrylic acid resin, rosin, modified rosin, turpentine resin, phenolic resin aliphatic hydrocarbon resin, alicyclic hydrocarbon resin, aromatic petroleum resin, paraffin wax, carnauba wax.

As for the coloring material added to the magnetic toner, they may be known carbon black, copper phthalocyanine, iron black or the like.

The magnetic fine particles contained in the magnetic toner may be of the material magnetizable when placed in a magnetic field, such as ferromagnetic powder of metal such as iron, cobalt and nickel, powder of metal alloy or powder of compound such as magnetite, $\gamma$-$Fe_2O_3$ and ferrite.

The fine magnetic particle preferably has BET specific surface area, obtained by nitrogen absorbing method of 1-20 $m^2/g$, more particularly 2.5-12 $m^2/g$, and a Moh's hardness of 5-7. The content of the magnetic particles is 10-70% by weight on the basis of the weight of the toner.

The toner may contain, as desired, a charge controlling agent, more particularly a negative charge controlling agent such as metallic complex salt of monoazo dye salicylic acid, alkyl salicylic acid, dialkyl salicylic acid or naphthoric acid or the like. Volume resistivity of the toner is preferably not less than $10^{10}$ ohm.cm, further preferably not less than $10^{12}$ ohm.cm from the standpoint of the triboelectric charge retention and the electrostatic image transfer. The volume resistivity here is defined as a value obtained in this method. The toner is caked with a pressure of 100 $kg/cm^2$, and an electric field of $10^0$ V/cm is applied, and then the current is measured after one minute from the electric field application. The resistivity is obtained from the current and the electric field, and is defined as the volume resistivity.

The amount of triboelectric charge of the negatively chargeable toner is preferably $-8$ $\mu C/g$ to $-20$ $\mu C/g$. If it is less than $-8$ $\mu C/g$, the image density is low, particularly under the high humidity conditions. If, on the other hand, it exceeds $-20$ $\mu C/g$, the charge of the toner is too high with the result of thin line images, so that the image is poor, particularly under low humidity conditions.

The negatively chargeable toner particles are defined in this manner. Under the conditions of 25° C. of the temperature and 50-60% of the relative humidity, 10 g of toner particles are left at rest one night. They are mixed with 90 g of carrier iron powder (for example, EFV 200/300 available from Nihon Teppun Kabushiki Kaisha, Japan) without resin coating and having a major particle size of 200-300 mesh under the above conditions, in an aluminum pot having a volume of 200 $cm^3$. It is then shaken vertically by hand approximately 50 times. Then, the triboelectric charge amount of the toner particles is measured by a normal blow-off method using aluminum cell having a 400 mesh screen. If the triboelectric charge produced by this method is negative, the toner particles are negatively chargeable toner particles.

As for the fine silica particles used for the purpose of increasing the fluidability of the developer, they may be dry silica produced from silica halogen compound by vapor phase oxidation, a dry silica called "fumed silica" or "wet silica" produced from water-glass or the like. However, the dry silica is preferable since the surface and inside thereof contain less silanol group and less residual materials. During the production of the dry silica, metallic halide such as aluminum chloride and titanium chloride together with the silica halide may be used, by which compound fine powder of silica and other metal oxide can be produced. The dry silica includes such material.

The fine silica particle has preferably been treated to acquire hydrophobic nature. The method for this treatment may be one of known methods. For example, by the chemical treatment with organic silica compound reactable with, or physically attachable with fine silica particles, the hydrophobic nature is given. As a preferable method, fine silica particles produced by vapor phase oxidation of the silica halide are treated with silane coupling agent, and thereafter or simultaneously therewith, it is treated with an organic silica compound.

The degree of the hydrophobic nature of the finally treated fine silica particles is 30-80 as a preferable range, since then triboelectric charge distribution of the developer containing such fine silica particles provides discrete and uniform negative electric property. Here, the degree of the hydrophobic nature is measured by titration test of methanol.

The methanol titration test is to determine the degree of the hydrophobic nature of the silica fine particles having surfaces of hydrophobic nature.

The methanol titration test is performed in this manner. In the water (50 ml) in conical flask having a capacity of 250 ml, 0.2 g of silica fine particles to be tested is added. Methanol is dropped from buret until all of the silica particles are wet. At this time, the liquid in the flask is always stirred by a magnetic stirrer. The end is determined by all of the silica particles becoming in suspended state. The degree of the hydrophobicity is expressed as a percentage of the methanol in the mixture of the methanol and the water.

The amount of the silica fine particles to the toner is preferably 0.05-3 parts by weight based on weight of the toner (100 parts), further preferably, it is 0.1-2 parts by weight, since then the developer exhibits stabilized charging property. It is preferable that 0.01-1 part, by weight based on the weight of the developer, of the silica fine particles are deposited on the surface of the toner particle.

The developer may contain, as long as no adverse affect is given, another or other materials, for example, a lubricant such as tetrafluoroethylene resin and zinc stearate, an agent for assisting image fixing (for example, low-molecular-weight polyethylene resin) or an agent for providing electric conductivity such as metal oxide such as tin oxide, or the like.

As for the method of producing the toner, the constituting materials are kneaded by a heat-kneader such as heated roll, extruder or other kneader. Then, the product is mechanically pulverized and classified. Alternatively, the materials are dispersed in binder resin liquid, and then it is sprayed and dried. Further alternatively, the desired materials are mixed into the monomeric material constituting the binder resin, and then it is emulsified, and thereafter, polymerized.

The description will now be made as to the embodiment of the developing apparatus.

Figure 3:
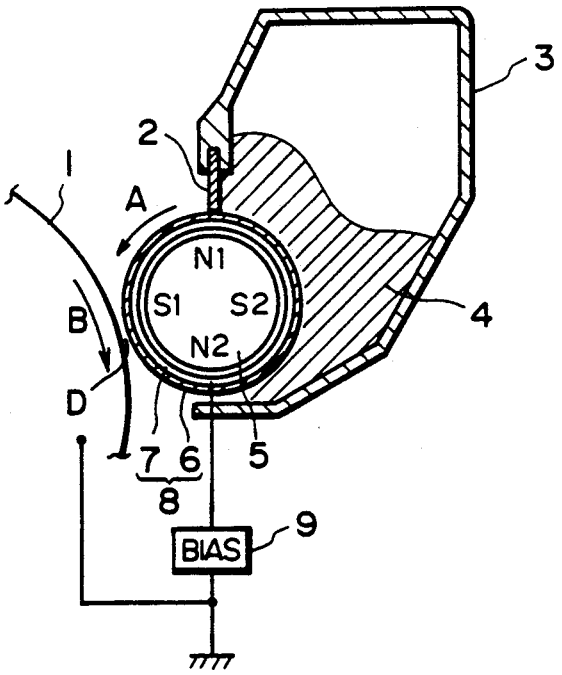
FIG. 3 is a sectional view of a developing apparatus according to an embodiment of the present invention.

Referring to FIG. 3, an image bearing member, that is, an electrophotographic photosensitive drum 1 having an electrostatic latent image formed through a known process, in this embodiment, rotates in the direction indicated by an arrow B. A developer carrying member, that is, a developing sleeve 8 in this embodiment, carries a one component magnetic developer 4 supplied from the hopper 3, and rotates in the direction A to carry the developer into a developing zone D where the sleeve 8 and the drum 1 is opposed to each other. In order to magnetically attract and retain the developer on the sleeve 8, a magnet 5 is disposed in the sleeve 8.

In order to regulate the thickness of the layer of the developer conveyed to the developing zone D, a regulating blade 2 made of a ferromagnetic metal is opposed to the developing sleeve 8 surface with a gap of 200-300 microns. By concentration of magnetic lines of force from a magnetic pole N1 of the magnet 5 onto the blade 2, a thin layer of the magnetic developer is formed on the sleeve 2. In place of the magnetic blade 2, a non-magnetic blade is usable.

The thickness of the thin developer layer formed on the sleeve 8 is preferably smaller than the minimum clearance between the sleeve 8 and the drum 1 in the developing zone D. The present invention is particularly effective when used with the above-described type developing device, that is, a non-contact type developing device wherein the layer of the developer has such a thickness. However, the present invention is also applicable to a contact-type developing device wherein the thickness of the developer in the developing zone is larger than the clearance between the sleeve 8 and the drum 1. The following descriptions will be made with respect to the non-contact type developing device for simplicity.

The sleeve 8 is supplied with a developing bias voltage from the voltage source 9 so as to transfer the developer from the developer layer carried on the sleeve to the drum 1. If a DC voltage is used for this bias voltage, the voltage applied to the sleeve 8 is preferably between the potential of the image area of the latent image (the area to which the developer is to be deposited, and therefore, to be visualized) and the potential of the background area. In order to increase the image density of the developed image or in order to improve the tone reproducibility, an alternating bias voltage may be applied to the sleeve 8 to form a vibrating electric field in the developing zone D. In this case, it is preferable that the alternating voltage is provided by superimposing an AC voltage with a DC voltage having a level between the image portion potential and the background potential (U.S. Pat. No. 4,292,387). In a regular development wherein the toner is deposited to a high potential portion of the latent image constituted by the high potential portion and a low potential portion, the toner used is chargeable to a polarity opposite to the polarity of the latent image, whereas in a reverse-development wherein the toner is deposited to the low potential area of the latent image, the toner used is chargeable to the polarity which is the same as the polarity of the latent image. Here, the high potential and low potential is on the basis of an absolute value of the potential. In any event, the toner is electrically charged by the friction with the sleeve 8 to the polarity for developing the latent image. The added fine silica particles are also electrically charged by the friction with the sleeve 8.

Figure 4:
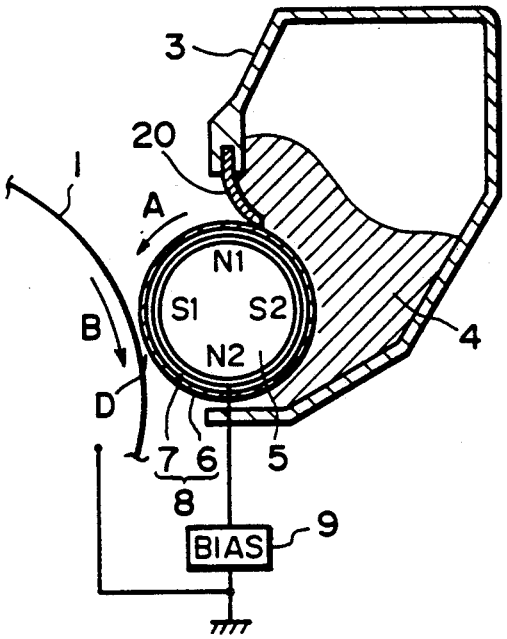
FIG. 4 is a sectional view of a developing apparatus according to another embodiment of the present invention.
Figure 5:
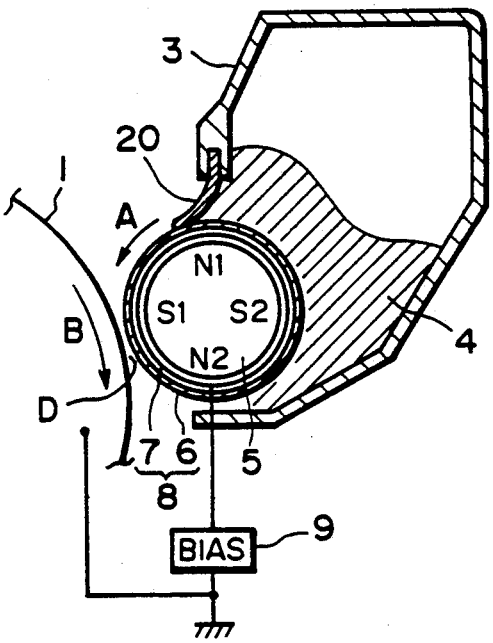
FIG. 5 is a sectional view of a developing apparatus according to a further embodiment of the present invention.

In the developing devices shown in FIGS. 4 and 5, an elastic plate 20 is employed as a member for regulating the layer thickness of the developer. The elastic plate 20 may be made of an elastic rubber such as urethane rubber and silicone rubber or elastic metal such as phosphor bronze and stainless steel. The elastic plate 20 is press contacted to the sleeve 8. With this structure, a further thinner developer layer can be formed. The apparatus wherein as shown in FIGS. 4 and 5, the developer thin layer is formed, is suitable both for an apparatus using a one component magnetic developer and for a one component non-magnetic developer mainly consisting of a non-magnetic toner. In this apparatus, since the toner is rubbed to the sleeve 8 by the elastic plate, and therefore, the amount of charge becomes large, thus contributing increase of the image density. Therefore, it is suitable for a measure against the insufficient toner charge under high humidity conditions.

The developing sleeve 8 is made of a cylindrical metal base 7 of aluminum, stainless steel, brass coated with an outer coating layer 6. The developer is carried on the coating layer 6, and the developer is triboelectrically charged by the outer coating layer 6. The coating layer 6 is made of a resin in which conductive fine particles are dispersed. Many conductive fine particles are exposed at the surface of the resin. As for the material of the conductive particles, carbon fine particles, graphite particles or the mixture thereof are preferable.

An example of the coating layer will be described. As for the resin, a heat-curing phenol resin was used.

TABLE 1

| | Example 1 | Example 2 | Example 3 |
|---|---|---|---|
| Resin | phenol resin 50 wt. parts | phenol resin 50 wt. parts | phenol resin 50 wt. parts |
| Carbon | carbon 10 wt. parts | carbon 25 wt. parts | carbon 45 wt. parts |
| Diluent | methylalcohol + methyl-cellosolve 100 wt. parts | methylalcohol + methyl-cellosolve 200 wt. parts | methylalcohol + methyl-cellosolve 200 wt. parts |

The carbon used was "RAVEN 1035" available from Columbian Carbon Japan, Limited. The volume average particle size thereof was approximately 20 microns. The aluminum cylindrical base 7 was sandblasted by ALANDOM abrasive grain No. 400. A coating was applied thereon by a dipping method or spray method in the thickness of approximately 1.0–1.5 microns. In the experiments, the phenol resin which was one of heat-curing resins was used, and therefore, it was heat-cured in a drying oven at 150° C. for 30 min. The developer carrying member 8 produced in this manner was used for development to compare the production of ghost images when negative toner was used. The positive ghost prevention effect was better in the order of examples 3, 2 and 1. The developing operation was performed with the non-contact type jumping development. The developing bias applied was an AC bias having a peak-to-peak voltage of 1600 V and the frequency of 1800 Hz. The clearance between the sleeve and the drum was approximately 300 microns. The ghost preventing effect was better when the thickness of the outer layer was 1.0–3.0 microns.

The inventors considered that there was a close relation between the electric resistance of the outer coating layer and the production of the ghost image, and further investigations were made using a highly conductive carbon having a better electric conductivity than the RAVEN 1035.

EXAMPLE 4

| | |
|---|---|
| Resin: phenol resin | 50 wt. parts |
| Carbon: Conductex 975U B (available from Columbian Carbon Japan) | 25 wt. parts |
| Dilutent: | 200 wt. parts |

The other conditions and production of the outer coating layer were as described above. As for the thickness of the coating layer, 0.5–30 microns were used. The negative toner was used under the same developing conditions and under a low humidity condition which is most influential to the production of the ghost image, and the results were better as compared with the above examples 1–3. When the amount of the conductive carbon was changed in the range of 20–90% on the basis of the resin, the ghost prevention effect was observed. However, when the negative toner was used, the ghost preventing effect was sometimes insufficient under the low humidity condition which is most influential to the ghost image production. Then, the inventors considered the leakage site of the charge of the fine particle toner from the standpoint other than the electric resistance.

It is apparent from the Examples 1–4 that the electric resistance of the outer coating layer is more or less effective, but if it alone is influential, the resistance is lower if the outer coating layer is not provided.

Then, the inventors have particularly noted the following. If the surface of the outer coating layer is rough, the electric charge concentration is produced by the conductive particles, so that the charge flows into the sleeve. By this, the electric charge of the fine particles which have been charged up can be removed. In view of this, the dispersed state of the carbon particles in the resin is changed in the Example 4, by which the average particle size of the secondary particles each of which is the mixture of resin and the conductive carbon was changed. A correlation was found between the positive ghost preventing effect and the size and distribution of the secondary particles. More particularly, when the observation was made using a scanning type electron microscope, (1) if the average size of the secondary particles on the outer coating layer surface was not more than approximately 1 micron, a substantially complete ghost image preventing effect was provided even under the low humidity conditions, but the effect lowered if the size was larger; (2) if substantially a flat surface was formed, the ghost preventing effect was lowered, and if the distance between the secondary particles was approximately 0.05–2.0 microns on the average, the high preventing effect was provided (the depth of the clearance between the secondary particles was not less than approximately that of one average secondary particle, more particularly, 0.1–30 microns within the thickness of the coating layer); and (3) there was a preferable range in the electric resistance of the outer coating layer when the ghost preventing effect was provided, but the configuration of the outer layer contacted to the toner was rather more important than the volume resistivity of the coating layer.

The above results are summarized in the following Table.

In the case of conductive carbon:

TABLE 2

| Resistivity % Thickness | Coating Surface: Rough (Gravel Type) | Coating Surface: Flat |
|---|---|---|
| $10^2$–$10^{-3}$ ohm.cm 0.5–30 microns | good even under low humidity conditions | no good under low humidity conditions |
| $\geqq 10^2$ ohm.cm 0.5–30 microns | Charge-up of toner occurs if resistivity is high | Charge-up of toner occurs to to impractical extent |

In the above example, it has been found that when the average volume resistivity of the outer coating layer is $7\times10^1-7\times10^{-2}$ ohm·cm, the ghost image preventing effect is high. Further, the ghost image preventing effect is higher when the average particle size of the secondary particles of the surface of the coating layer is 0.1–0.3 micron, and the intervals between the secondary particles are 0.1–0.4 micron on the average.

Here, the secondary particle is the resin coagulated in the form of a particle containing dispersed conductive particles. The secondary particles are formed by the layer being separated finely by passages formed by the evaporated diluent venting. Or, if the coating is applied by spray, the secondary particles are formed by the droplets of the spray.

Figure 6:
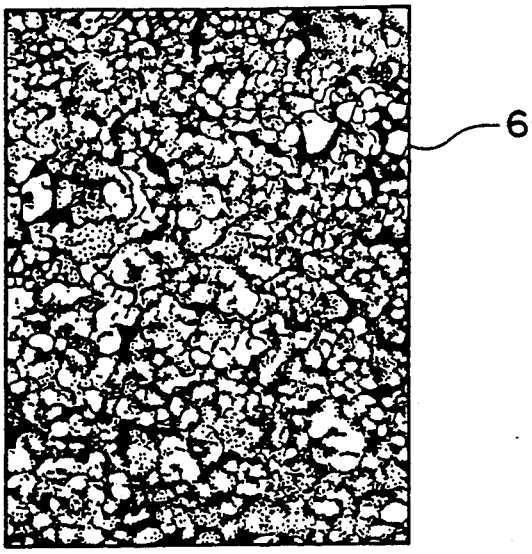
FIG. 6 is a drawing of an electronic microscope photograph of a surface of a coating layer.

FIG. 6 is an electron microscopic photograph of the surface of the outer coating layer on which the secondary particles are distributed on the surface of the outer coating layer in the form like a graveled path.

Figure 7:
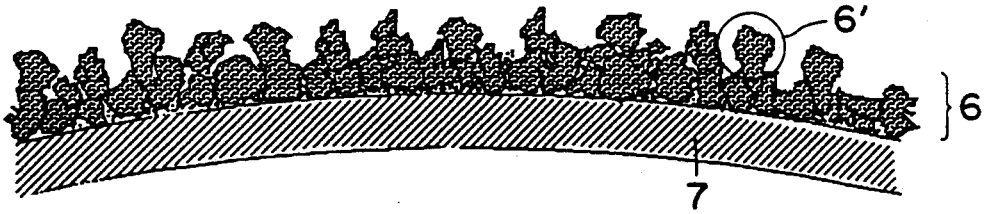
FIG. 7 is an enlarged sectional view of a surface of a sleeve.
Figure 8:
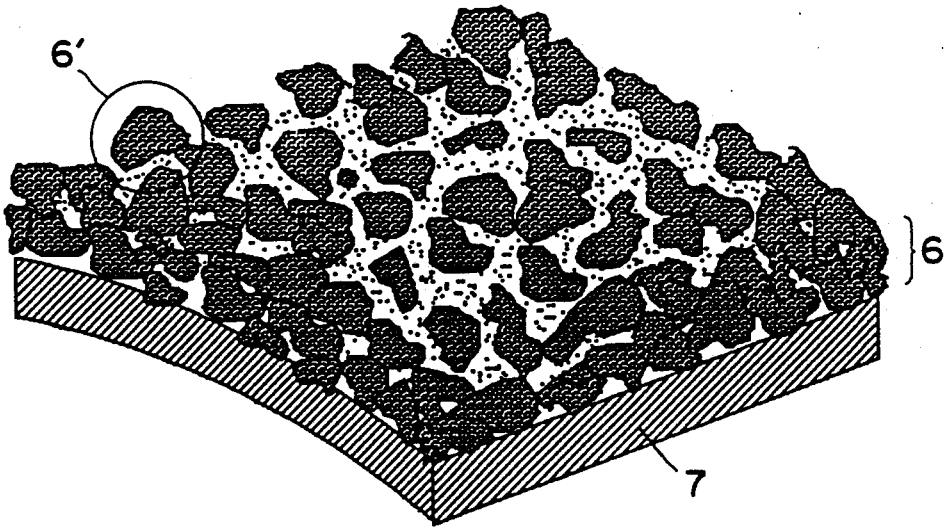
FIG. 8 is a perspective enlarged view of the surface of the sleeve.

FIG. 7 is a schematic view of a cross-section of the sleeve 8, and FIG. 8 is a perspective view. Designated by the reference 6' are the secondary particles. A great number of secondary particles 6' are distributed on the outer surface to form a rough surface such as graveled path. By providing the outer coating layer on which the secondary particles 6' are distributed in the form of a graveled path, the contact resistance between the toner and the outer coating layer is in effect reduced (production of leakage site). By this, the electric charge of the fine particle toner is easily leaked. The volume resistivity of the coating layer is within a certain range because if the conductive sleeve is not used with the insulating toner, the toner charge-up occurs macroscopically with the result of reduction of the image density and in the production of the ghost image. From this standpoint, the volume resistivity of the outer coating layer is preferably not more than $10^3$ ohm.cm.

As regards the thickness of the coating layer, the lower limit is determined in terms of the density of the leakage site between the toner and the secondary particles. More particularly, the thickness thereof is preferably not less than 0.5 micron. As regards the upper limit of the film thickness of the coating layer, the conductive particle containing resin layer in the present invention has a high volume resistivity with respect to metal, and therefore, if the thickness is too large, the intended effects are reduced. From this, the thickness of the coating layer is not more than 30 microns.

The inventors have confirmed the effects by comparing the amount of charge of the toner at the upper portion on the thin layer of the developer and that of the bottom layer of the toner layer.

Figure 9:
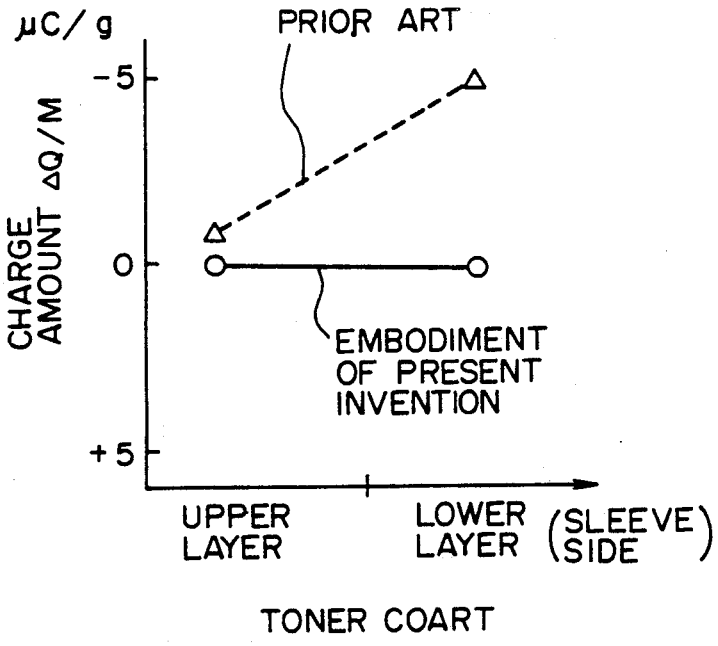
FIG. 9 is a graph illustrating a difference in the amount of the toner charge in a conventional apparatus and an apparatus according to the present invention.

FIG. 9 shows the difference of the amounts of charge between the white portion (the area of the sleeve opposed to the background of the latent image) and the black portion (the area of the sleeve opposed to the image portion of the latent image). The abscissa represents the position of the toner coating, and the ordinate represents the difference in the charge amounts, that is:

Triboelectric charge difference ($\Delta Q/M$) = white Q/M − black Q/M where Q/M is amount of toner charge.

It is understood that in the conventional sleeve, as indicated by broken lines, the charged-up toner are present in the bottom layer of the toner coating, whereas in the embodiment of the present invention (Example 4), the amount of the charged-up toner is significantly reduced.

A further embodiment of the present invention will be described. In this embodiment, graphite particles, which are electrically conductive fine particles having solid lubricity, are mixed in the coating layer of the developer carrying member, for the purpose of weakening the mechanical attraction of the fine particles to the developer carrying member, in order to further assure the ghost image preventing effect particularly under low humidity conditions. The other features are the same as in the previous embodiment. It has been confirmed that the developer carrying member has a very high ghost image preventing effect for a positive ghost image.

EXAMPLE 5

| | |
|---|---|
| Resin: phenol resin | 50 wt. parts |
| Carbon: CONDUCTEX 975 U B (Columbian Carbon Japan) | 12 wt. parts |
| graphite (Showa Denko Kabushiki Kaisha, Japan) | 13 wt. parts |
| Diluent: methylalcohol methylcellosolve | 200 wt. parts |

A further embodiment will be described. In this embodiment, electrically conductive fine particles made of carbon and electrically conductive fine particles made of graphite having lubricant nature are dispersed in light-curing resin. The conductive fine particle containing resin layer has an average volume resistivity of $10^2$–$10^{-2}$ ohm.cm, and a thickness between 0.5–5 microns. The size of the secondary particles made of the conductive fine particles and the resin is not more than 1.0 micron. The coating layer has a surface on which the secondary particles are distributed in the form of a gravel road. In this embodiment, the production of the positive ghost when a negative toner is used is reduced or removed.

The following is an example of this embodiment:

EXAMPLE 6

| | |
|---|---|
| Light curing resin: epoxyacrylate and urethane | 100 wt. % |
| Carbon black: CONDUCTEX 975 U B | 20 wt. parts |
| graphite | 10 wt. parts |
| Diluent: acetone | 300 wt. parts |

The ghost image preventing effects of this embodiment has been confirmed to be substantially sufficient, similarly to the foregoing embodiments.

With the sleeve having a coating layer made of resin in which fine graphite particles are dispersed, the ghost image preventing effect is higher than conventional developing sleeves even under low humidity conditions, even if the number of the secondary particles having the particle size of not more than 1 micron on the surface is small and even if the secondary particles are not distributed in the form of the gravel road as shown in FIGS. 6–8. This is because the lubricant effect of the graphite is so high that the amount of the fine particles attached to the surface of the sleeve is reduced. It is noted, however, that such a coating layer has a number of fine projections on the surface because the fine particles are mixed.

In order to improve the resolution of the developed image, the size of the toner particles is preferably small, and the volume average particle size is preferably not more than 9 microns and not less than 4 microns. The reason is that the image sharpness is not so improved when a latent image in the density of 19 pel or 23.6 pel is produced, if the volume average particle size is more than 9 microns; that if the volume average particle size is less than 4 microns, it is difficult to contain the magnetic particles such as magnetite in the resin with stability, and it is difficult to produce the magnetic toner having the volume average particle size of less than 4 microns because of high cost for the pulverization and classification. In any event, the number of fine particles is larger in the developer suitable for the high resolution.

According to the present invention, the developing sleeve is provided with a conductive resin layer containing carbon particles for providing the electrical conductivity. By this, the sleeve ghost and the gradual image density reduction with use, attributable to the fine toner particles attached to the surface of the developing sleeve, is reduced.

A sleeve of the developing device using the small size toner particles has an outer coating layer 6 which is made of a resin layer containing conductive fine particles such as carbon particles having an average particle size of approximately 20 milli-microns (20/1000 microns). It is preferable that the resin layer has the average volume resistivity of $10^{-3}$—$10^2$ ohm.cm, that the thickness is 1.0–20 microns, that the fine conductive particles are exposed on the surface layer, and that the secondary particles made of the fine conductive particles and the resin have a particle size of not more than 1.5 micron.

The content of the fine conductive particles contained for the purpose of providing the electrical conductivity, in the coating layer 6 is 30–70% by weight. Preferably, 30–100% by weight of graphite may be contained in the fine conductive particles.

An example of the outer coating layer is as follows:

EXAMPLE 7

| | |
|---|---|
| Resin: phenol resin | 50 wt. parts |
| Carbon: CONDUCTEX 900 (Columbian Carbon Japan) | 50 wt. parts |
| Diluent: methyl alcohol methylcellosolve | 250 wt. parts |

The thickness of the conductive resin layer 6 formed on the cylindrical base 7 was approximately 4 microns.

A developing apparatus having the structure shown in FIG. 3 and having the above-described developing sleeve was operated under low humidity conditions using small size toner particles as the developer, so as to evaluate the prevention of the ghost image production. It was confirmed that the production of the ghost image was greatly reduced as compared with a conventional developing sleeve made of conductive metal.

The toner used in this embodiment contains as a major component styrene acrylic copolymer material, and contains 90 parts by weight of magnetite for providing a magnetic property, 2 parts by weight of nigrosine as a charge controlling agent. The toner particles are produced by pulverization and classification. The volume average particle size is 6 microns, and the number distribution of the particles having the volume average particle size of not more than 3.5 microns is not more than 20%, and the volume distribution of the particles having the volume average particle size of not less than 16 microns is not more than 1%. The toner is positively chargeable toner. In order to increase the fluidability and to stabilize the charge of the toner, amino-modified silicone oil treated silica is added in the amount of 0.8% by weight.

In a conventional developing sleeve having a metal surface roughened by sandblasting or the like, it is considered that an insulating layer is formed on the metal surface by an oxidized film, and therefore, the leakage of the electric charge of the fine particles is not sufficient. In the case of the metal-plated surface, Au-plated sleeve alone exceptionally showed good results. This fact supports the above-described consideration by the inventors.

Further embodiments of the present invention will be described.

EXAMPLE 8

| | |
|---|---|
| Resin: phenol resin | 50 wt. parts |
| Carbon: CONDUCTEX 900 (Columbian Carbon Japan) | 10 wt. parts |
| graphite CSPE (Nihon Kokuen Kabushiki Kaisha) | 40 wt. parts |
| Diluent: methyl alcohol methyl cellosolve | 250 wt. parts |

Outer coating layer 6 made of the above material had a thickness of approximately 6 microns, the volume resistivity of $5.0\times10^{0}$ ohm.cm (measured by four probe method), and the surface resistivity of $7.3\times10^{-3}$ ohm/□.

The developing apparatus having the structure of FIGS. 4 and 5 and having the developing sleeve with the coating layer described above was operated using the small particle size toner to evaluate the ghost image preventing effect. It was confirmed that the production of the ghost image and the reduction of the image density were greatly improved as compared with the conventional conductive sleeve of metal and the above-described Example 7.

The small size toner contained as the major component styrene acrylic copolymer material, and contained 90 parts by weight of magnetite for providing a magnetic property, and 2 parts by weight of monoazo metal complex material for providing the charge controlling effect. The toner was negatively chargeable. The volume average particle size of the toner was 6 microns. The toner contains not more than 20%, in the number distribution of the particles having the volume average particle size of not more than 3.5 microns, and not more than 1%, in the volume distribution, of the particles having the volume average particle size of not less than 16 microns. In order to increase the fluidability of the toner and to stabilize the toner charge, 0.8% by weight of negatively chargeable dry silica particles treated with hexamethylenedisilazane was added. With this negatively chargeable small particle size toner, the ghost image preventing effect and the image density reduction preventing effect were worse than with the positively chargeable fine toner, when the latent image formed on the photosensitive drum is developed. Then, the positively chargeable fine toner and the negatively chargeable fine toner are compared, and it has been found that there is a difference in the amount of charge of the toner, and the charge of the negatively chargeable fine toner is approximately $-25\ \mu C/g$ measured in two component triboelectric measurement method, whereas that of the positively chargeable fine toner is $+18\ \mu C/g$. This is because the resin of the toner is more chargeable to the negative polarity. Therefore, the production of the ghost image and the reduction of the image density with use are larger in the case of the negatively chargeable toner.

When the negatively chargeable fine toner is used, and the developing sleeve is as described with Example 7, the ghost image preventing effect and the image density reduction preventing effect are not sufficient, and it has been confirmed that after 1000–2000 sheets are developed and printed, the above effects lower to substantially the same level as in the conventional conductive metal sleeve, although the number of prints until the effects are lowered is larger than with the metal sleeve.

Then, the developing sleeve was investigated, and was found to have been contaminated on its surface by the resin component or silica in the toner. It was confirmed that by cleaning the surface of the developing sleeve 8 by washing or wiping with wet waste, the image density and the ghost image preventing effect became as in the initial state.

Then, the inventors considered that the fine toner particles were more easily removed from the surface of the developing sleeve by containing in the coating layer graphite particles having solid lubricity, particularly, having cleavage crystal surface. And, conductive fine graphite particles were added. As a result, the surface of the developing sleeve 8 having an outer coating layer containing the graphite was not contaminated by the resin component or the silica in the toner even after 10,000 sheets were printed.

The fine carbon particles preferably have the volume average particle size of 5–100 microns, and the volume average particle size of the graphite particles is preferably 0.5–10 microns. When the fine carbon particles and fine graphite particles were used in mixture as the fine conductive particles, not less than 40% and not more than 90% by weight of the graphite on the basis of the carbon was further preferably contained. In addition, the weight ratio of the fine conductive particles (carbon or the mixture of the carbon and graphite) to the binder resin is further preferably 1:4–2:1. If the resin component is too large, the surface becomes too smooth, and if it is too small, the mechanical strength of the coating layer is reduced to become unsuitable to the developing sleeve. As for the resin binder, heat-curing resin such as polystyrene, butyral, vinyl chloride - vinyl acetate and PMMA, ultraviolet ray curable resin such as epoxyacrylate, water high polymer such as casein, and glue. In addition, the mechanical strength of the binder may be increased by dispersing in the binder $TiO_2$, $SnO_2$, Si-alkoxide-type conductive ceramic powder.

As for the fine conductive particles, fine particles of stainless steel, zinc and other metals are usable.

As for the cylindrical base 7 on which the outer coating layer is formed, the surface thereof may be blast-treated by spherical grains, or it may have a smooth surface.

As for the toner, the non-magnetic toner is usable in this invention. That is, the present invention is usable with not only the one component magnetic developer but also one component non-magnetic developer.

As described, according to the present invention, the fluidability of the developer on the developer carrying member surface is improved, and therefore, the consumption efficiency of the developer during the developing operation is increased, and the reversal of the charging property of the developer is prevented, thus reducing production of the foggy background by the reversely charged toner.

While the invention has been described with reference to the structures disclosed herein, it is not confined to the details set forth and this application is intended to cover such modifications or changes as may come within the purposes of the improvements or the scope of the following claims.

What is claimed is:

1. A developing apparatus for developing an electrostatic latent image, comprising:

a movable developer carrying member for carrying one component developer to a developing zone where said developer carrying member is opposed to a latent image bearing member for carrying the electrostatic latent image, said developer carrying member being effective to triboelectrically charge the developer to a polarity for developing the latent image;

a regulating member for regulating a thickness of a layer of the developer on said developer carrying member to a thickness smaller than a minimum clearance between said developer carrying member and the image bearing member; and a voltage source for applying a developing bias voltage to said developer carrying member to transfer the developer from said developer carrying member to said image bearing member;

wherein said carrying member is provided with an outer layer of resin material in which fine conductive particles containing fine carbon particles and fine graphite particles are dispersed, and wherein secondary particles formed by the resin material and the fine conductive particles are distributed at a surface of the outer layer to form a rough surface.

2. An apparatus according to claim 1, wherein the coating layer has an average volume resistivity of $10^{-3}$–$10^{2}$ ohm.cm and has a thickness of 0.5–30 microns.

3. An apparatus according to claim 2, wherein the secondary particles have a particle size of not more than 1.0 micron.

4. An apparatus according to claim 1 or 2, wherein said voltage source applies an alternating bias voltage to said developer carrying member.

5. An apparatus according to claim 1 or 2, wherein the resin material is a phenol resin.

6. An apparatus according to claim 1 or 2, wherein said regulating member is in contact with said developer carrying member.

7. An apparatus according to claim 6, wherein said regulating member includes an elastic plate.

8. An apparatus according to claim 1 or 2, further comprising a stationary magnet disposed in said developer carrying member, wherein said developer carrying member carries the one component magnetic developer, and said regulating member includes a ferromagnetic member disposed within the influence of a magnetic field formed by said magnet with a clearance from said developer carrying member.

9. An apparatus according to any one of claim 1, wherein said voltage source applies a DC bias voltage to said developer carrying member.

10. A developing apparatus for developing an electrostatic latent image, comprising:

a movable developer carrying member for carrying one component developer to a developing zone where said developer carrying member is opposed to a latent image bearing member for carrying the electrostatic latent image, said developer carrying member being effective to triboelectrically charge the developer to a polarity for developing the latent image;

a regulating member for regulating a thickness of a layer of the developer on said developer carrying member to a thickness smaller than a minimum clearance between said developer carrying member and the image bearing member; and a voltage source for applying a developing bias voltage to said developer carrying member to transfer the developer from said developer carrying member to said image bearing member;

wherein said developer carrying member has an outer coating layer of resin material in which fine graphite particles are dispersed.

11. An apparatus according to claim 10, wherein fine carbon particles are further dispersed in the resin material.

12. An apparatus according to claim 11, wherein the coating layer has an average volume resistivity of $10^{-3}$–$10^{2}$ ohm.cm.

13. An apparatus according to claim 12, wherein the coating layer has a thickness of 0.5–30 microns.

14. An apparatus according to any one of claim 10 wherein said voltage source applies an alternating bias voltage to said developer carrying member.

15. An apparatus according to any one of claims 10–13, wherein said voltage source applies to a DC bias voltage to said developer carrying member.

16. An apparatus according to any one of claims 10–13, wherein the resin material is a phenol resin.

17. An apparatus according to any one of claims 10–13, wherein said regulating member is in contact with said developer carrying member.

18. An apparatus according to claim 17, wherein said regulating member includes an elastic plate.

19. An apparatus according to any one of claims 10–13, further comprising a stationary magnet disposed in said developer carrying member, wherein said developer carrying member carries the one component magnetic developer, and said regulating member includes a ferromagnetic member disposed within the influence of a magnetic field formed by said magnet with a clearance from said developer carrying member.

20. A developing apparatus for developing an electrostatic latent image, comprising:

a movable developer carrying member for carrying one component developer, which contains toner to which negatively chargeable hydrophobic silica has been added, to a developing zone where said developer carrying member is opposed to a latent image bearing member for carrying the electrostatic latent image, said developer carrying member being effective to charge the toner to a negative polarity;

a regulating member of regulating the thickness of a layer of the developer on said developer carrying member to a thickness smaller than a minimum clearance between said developer carrying member and the image bearing member; and a voltage source for applying a developing bias voltage to said developer carrying member to transfer the toner from said developer carrying member to said image bearing member;

wherein said developer carrying member has an outer coating layer of resin material in which fine carbon particles and fine graphite particles are dispersed.

21. An apparatus according to claim 20, wherein the coating layer has an average volume resistivity of $10^{-}$–$10^{2}$ ohm.cm.

22. An apparatus according to claim 21, wherein the coating layer has a thickness of 0.5–30 microns.

23. An apparatus according to any one of claim 20, wherein said voltage source applies an alternating bias voltage to said developer carrying member.

24. An apparatus according to any one of claim 20, wherein said voltage source applies a DC bias voltage to said developer carrying member.

25. An apparatus according to any one of claim 20–24, wherein the resin material is a phenol resin.

26. An apparatus according to any one of claims 20–24, wherein said regulating member is in contact with said developer carrying member.

27. An apparatus according to claim 26, wherein said regulating member includes an elastic plate.

28. An apparatus according to any one of claims 20–24, further comprising a stationary magnet disposed in said developer carrying member, wherein said developer carrying member carries the one component magnetic developer, and said regulating member includes a ferromagnetic member disposed within the influence of a magnetic field formed by said magnet with a clearance from said developer carrying member.

* * * * *

UNITED STATES PATENT AND TRADEMARK OFFICE

CERTIFICATE OF CORRECTION

PATENT NO. : 4,989,044

DATED : January 29, 1991

INVENTOR(S) : KATSUHIKO NISHIMURA, ET AL.

It is certified that error appears in the above-identified patent and that said Letters Patent is hereby corrected as shown below:

In the Drawings

SHEET 4 OF 4

FIG. 9, "COART" should read --COAT--.

COLUMN 2

Line 12, "contination" should read --continuation--.

COLUMN 6

Line 61, "is" should read --are--.

COLUMN 15

Line 61, "any one of" should be deleted.

COLUMN 16

Line 26, "claim 10" should read --claims 10-13,--.

COLUMN 17

Line 6, "$10^{-}$-$10^{2}$ ohm.cm." should read --$10^{-3}$-$10^{2}$ ohm.cm.--.
Line 10, "any one of" should be deleted.
Line 14, "any one of" should be deleted.

UNITED STATES PATENT AND TRADEMARK OFFICE

CERTIFICATE OF CORRECTION

PATENT NO. : 4,989,044

DATED : January 29, 1991

INVENTOR(S) : KATSUHIKO NISHIMURA, ET AL.

It is certified that error appears in the above-identified patent and that said Letters Patent is hereby corrected as shown below:

COLUMN 18

Line 1, "claim" should read --claims--.

Signed and Sealed this

Eighth Day of September, 1992

*Attest:*

*Attesting Officer*

DOUGLAS B. COMER

*Acting Commissioner of Patents and Trademarks*